United States Patent [19]

Gunzelmann et al.

[11] 4,335,950

[45] Jun. 22, 1982

[54] FRAME ASSEMBLY WITH UPPER AND LOWER FRAME MEMBERS FOR AUTOMATIC REPRODUCING APPARATUS

[75] Inventors: Edward J. Gunzelmann, Fairport; Raghulinga R. Thettu, Webster; Larry M. Wood, Penfield, all of N.Y.

[73] Assignee: Xerox Corporation, Stamford, Conn.

[21] Appl. No.: 219,691

[22] Filed: Dec. 24, 1980

[51] Int. Cl.[3] ..... G03G 15/00

[52] U.S. Cl. ..... 355/3 R; 271/273; 355/3 SH

[58] Field of Search ..... 355/3 R, 3 DR, 133, 355/3 SH, 14 SH; D16/27-32; 271/272, 273, 274

[56] References Cited

U.S. PATENT DOCUMENTS

| | | | |
|---|---|---|---|
| 3,301,126 | 1/1967 | Osborne | 88/24 |
| 3,604,797 | 9/1971 | Szcezesniak | 355/16 |
| 3,661,383 | 5/1972 | Morrison | 271/273 |
| 3,743,406 | 7/1973 | Komori et al. | 271/273 X |
| 3,966,316 | 6/1976 | Pfeifer et al. | 355/3 DR |
| 4,114,998 | 9/1978 | Shimizu | 355/133 X |

*Primary Examiner*—Richard L. Moses

[57] ABSTRACT

Xerographic reproducing apparatus including a frame assembly made up of upper and lower molded plastic frame members, each frame member having sheet guiding elements integrally molded therein so that a sheet of copy paper being processed through the reproducing apparatus is guided along its path by the sheet guiding elements in the upper and lower molded plastic frame members. In a specific embodiment each of the frame members may have several machine element mounting means integrally molded therein and they are pivotally mounted relative to each other in clam shell fashion at one end and when in the closed position are securely positioned by cooperating datum points. With such construction control over the positioning of machine elements and in particular the paper path may be achieved at the time of construction and the cost and complexity of construction can be substantially reduced.

15 Claims, 15 Drawing Figures

45
49
67
49
68
61
62
66
65
49
61
63
27
60
57
58
49
50
51
46
47
56
52
50
50
55
75
44
76

FRAME ASSEMBLY WITH UPPER AND LOWER FRAME MEMBERS FOR AUTOMATIC REPRODUCING APPARATUS

REFERENCE TO RELATED APPLICATIONS

Reference is hereby made to the following copending applications filed concurrently herewith: U.S. Ser. No. 219,698 entitled "SHEET FEEDING APPARATUS" and filed by Victor (NMI) Shur and Raghulinga R. Thettu. U.S. Ser. No. 219,804 entitled "SHEET REGISTRATION ACTUATION" and filed by Michael A. Malachowski, Victor (NMI) Shur and Raghulinga R. Thettu. U.S. Ser. No. 219,692 entitled "SHEET FEEDING AND REGISTRATION APPARATUS" and filed by Victor (NMI) Shur and Raghulinga R. Thettu.

BACKGROUND OF THE INVENTION

This invention relates to automatic reproducing apparatus and to the frames, structure and covers used in such apparatus. In particular, the present invention relates to a machine frame structure which simplifies the construction of the paper path.

Historically in the manufacture of automatic reproducing machines, the construction initially was based on a main frame comprising one or more large die castings of aluminum or the like to which operational subassemblies such as a developer housing, cleaner housing or copy sheet transport would be mounted. Often times the subassemblies themselves were built on a small die cast frame members to which each of individual subassembly parts had to be fixed. Some machines, in large part, consisted of massive frames and subframe structures to which the individual operational elements were directly mounted or mounted through brackets. Typical of commercial products of this nature were the Xerox 914 and 3600 model copiers. The Xerox 3600 model is exemplified in U.S. Pat. No. 3,301,126 to Osborne et al.

The next step in the development of the frame structure was the use of sheet metal as the principle frame structures. Although some die castings were still used for mounting subassemblies, a rapid switch to the use of sheet metal and steel bracketing replaced the high level use of metal die castings. However the individual operational parts of the machine continued to be assembled first as a subassembly which was mounted to the main frame. Exemplary of this type of copier construction is the Xerox 4000 copier.

A later development in automatic reproducing machine construction was the use of a unitized type of construction which uses a sheet metal frame with as many of the individual operational elements being mounted directly to it. In this type of construction, the use of subassemblies is to a very large degree replaced by mounting the individual elements directly to the sheet metal frame. This type of construction is exemplified by that found in the Xerox 3300 copier. A variant of this type of construction uses straight pieces of sheet metal with punched and machined holes for mounting supporting brackets and machine elements.

In all these techniques, a very large number of suitable brackets, holders or subassembly frames are required to hold or mount every single piece of the entire operational structure of the machine onto the frame assembly. The number of parts including mounting blocks, brackets and fasteners is very large. In addition, it is necessary to drill or tap several suitable mounting holes in the frame and subframe structures. Further and perhaps most important from an operational sense, every mounted element or assembly must be adjusted for operational tolerances relative to its frame structure as well as relative to the other operational elements or assemblies with which it interacts. For example, the developer assembly, charging corotron assembly and cleaning assembly must all be aligned and adjusted for operational tolerances with the photoconductor drum. It also frequently happens that these adjustments become loose with time and use and must be continuously aligned for maximum operational efficiency and copying quality. In addition the assembly costs to put all these parts together and adjust them increases to a very high degree as the number of parts and complexity of adjustment increases. Simply said, it cost more to install every single screw in a machine.

Traditionally one of the operational aspects of automatic reproducing machines over which a great degree of control and precision adjustment is required is with regard to the paper supply to the copy output station. Typically, these paths have been defined by separate paper transports made from sheet metal with belt or roller drives for different parts of the machine and by baffles, gates, stops, etc., all separately mounted to the machine main frame or selected sub-assemblies. Representative of this type of construction is the paper path shown in U.S. Pat. No. 3,301,126 to Osborne et al which in FIG. 2 illustrates separate paper transports from the supply to the drum, from the drum to the fuser and from the fuser to the output station. In addition to these principal transport assemblies, a number of baffles, gates and brackets are used to guide or direct the copy sheet through its path. If any one of these elements which are mounted to its main frame or smaller subassemblies becomes misaligned there is the possibility of a paper jam or damage to paper occurring. The probability of this happening of course increases with the number of elements that must be mechanically aligned or adjusted in the machine. If some element comes out of adjustment, it may even require that use of the reproducing machine be discontinued until a trained technician can readjust the element to its proper position which detracts from overall reliability and user satisfaction.

PRIOR ART

In addition to the prior art described above, it is noted that the integration of machine elements or operational units into plastic molded or shaped frames and cover units has been carried out for several years in a number of types of products such as, for example, hand tools, toys and electric razors.

SUMMARY OF THE INVENTION

In accordance with this invention an automatic reproducing apparatus including a frame assembly with integrated machine elements is provided. This frame assembly drastically reduces the number of parts necessary to be assembled for a complete reproducing machine, the assembly time, the overall cost of manufacture and the operational reliability of the paper handling system in the complete machine.

More particularly, the present invention is directed to a frame assembly made of upper and a lower molded plastic frame members, the upper frame member having sheet top guiding elements integrally molded therein and the lower frame member having sheet bottom guiding elements integrally molded therein such that when a copy sheet is being processed through the reproducing apparatus it is guided along its path by the top and bottom sheet guiding elements.

The present invention provides in a specific embodiment a xerographic reproducing apparatus wherein each frame member may have several machine element mounting means integrally molded therein and which are pivotally mounted relative to each other in clamshell fashion at one end and which when in the closed position, are securely positioned by datum points.

Accordingly it is an object of the present invention to provide a novel automatic reproducing apparatus.

It is a further object of the present invention to provide a novel integrated frame structure for an automatic reproducing machine.

It is a further object of the present invention to provide a more economical and easier to manufacture automatic reproducing machine.

It is an additional object of the present invention to provide a machine frame structure providing more reliable placement of machine elements.

It is an additional object of the present invention to provide a novel copy sheet transport apparatus.

It is a further object of the present invention to provide a copy sheet transport path defined by integrally molded elements in two cooperating frame members.

It is a further object of the present invention to integrate selected operational elements into a molded plastic frame structure for the reproducing machine.

It is a further object of the present invention to reduce the number of individual parts in an automatic reproducing machine.

For a better understanding of the invention as well as other objects and further features thereof, reference is had to the following drawings and description.

BRIEF DESCRIPTION OF THE DRAWINGS

The invention will now be described by reference to a preferred embodiment of the sheet feeding apparatus.

Figure 1:
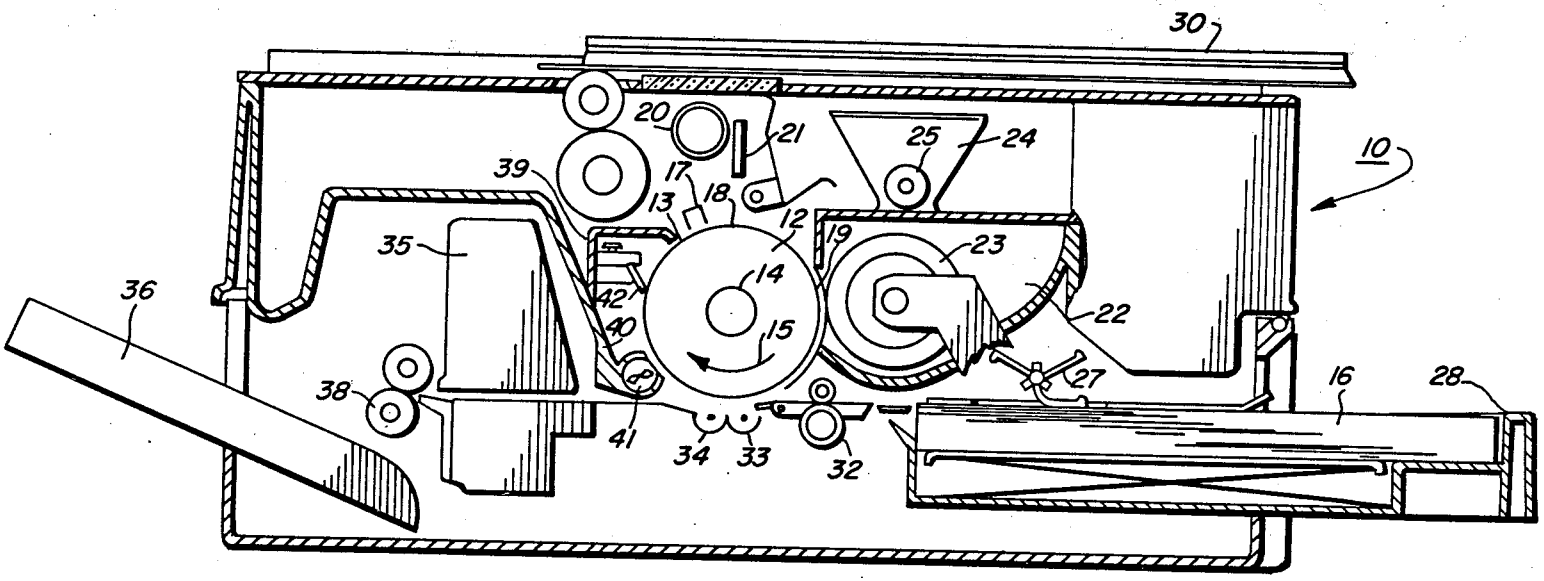
FIG. 1 is a schematic representation in cross-section of the operational elements of an automatic reproducing machine that may be assembled according to the present invention.

Referring now to FIG. 1 there is shown by way of example the operational element organizational geometry of an automatic xerographic reproducing machine 10 which may use the integrated frames and sheet guides of the present invention. The integrated frames and sheet guides themselves may be more clearly seen with reference to FIGS. 2, 3A, 3B, 3C and 4. The reproducing machine 10 depicted in FIG. 1 illustrates the various operational elements and components utilized for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown in this Figure) by means of shaft 14 and rotates in the direction indicated by arrow 15 to bring the imagebearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 where the charged photoconductive surface 13 is exposed to a light image of the original input scene information whereby the charge is selectively dissipated in the light exposed regions to record the original input scene in the form of an electrostatic latent image. At the exposure station, the image received on the drum is one which is formed by illuminating the document on the moving platen 30 by exposure lamp 20 and transmitting the image through lens assembly 21 to the photoconductor surface. The lens assembly comprises a bundled array of gradient index optical fibers which are produced under the trade name "SELFOC" in Japan by Nippon Sheet Glass Co., Ltd. and which are described in U.S. Pat. No. 3,658,407 to Kitano et al. After exposure, drum 12 rotates the electrostatic latent image recorded on the photoconductive surface 13 to development station 19 wherein a conventional developer mix is applied to the photoconductive surface on the drum 12 rendering the latent image visible. Typically a suitable development station could include a developer housing 22, a magnetic brush development roll 23 utilizing a magnetizable developer mix having coarse ferromagnetic carrier granules and toner colorant particles which is dispensed from dispenser 24 by dispenser roll 25.

Sheets 16 of the final support material are supported in a stack arrangement on an elevating stack support tray 28. With the stack at its elevated position a sheet separator feed paddle wheel 27 feeds individual sheets therefrom to the registration system 32. The sheet is then forwarded to the transfer station 33 in proper registration with the image on the drum. The developed image on the photoconductive surface 13 is brought into contact with the sheet 16 of final support material within the transfer station 33 and the toner image is transferred from the photoconductive surface 13 to the contacting side of the final support sheet 16. Following transfer of the image the final support material which may be paper, plastic, etc., as desired is transported through detack station where detack corotron 34 uniformily charges the support material to separate it from the drum 12.

After the toner image has been transferred to the sheet of final support material 16 the sheet with the image thereon is advanced to a suitable fuser 35 which coalesces the transferred powder image thereto. After the fusing process the sheet 16 is advanced to a suitable output device such as tray 36 by output rolls 38.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 39 which includes cleaner housing 40 and auger 41. The toner particles may be mechanically cleaned from the photoconductive surface 13 by any conventional means as, for example, by the use of a cleaning blade 42.

Normally, when the copier is operated in a conventional mode, the original document to be reproduced is placed image side down upon a horizontal transparent viewing platen 30 and the original is then transported by way of the moving platen which rides on rails (not shown) past the stationary optical system.

As the document is transported past the optical system, the copy sheet is delivered to the transfer station at the same speed so that a faithful reproduction may be obtained. This is accomplished through the use of a continuously rotating paddle wheel feeder 27 which drives successive sheets from a stack into the registration system 32 which first registers the sheets and then drives them forward at a speed synchronized to that of the document transport.

It is believed that the foregoing general description is sufficient for purposes of the present application to illustrate the general operation of an automatic xerographic copier 10 which can embody the apparatus in accordance with the present invention.

Figure 2:
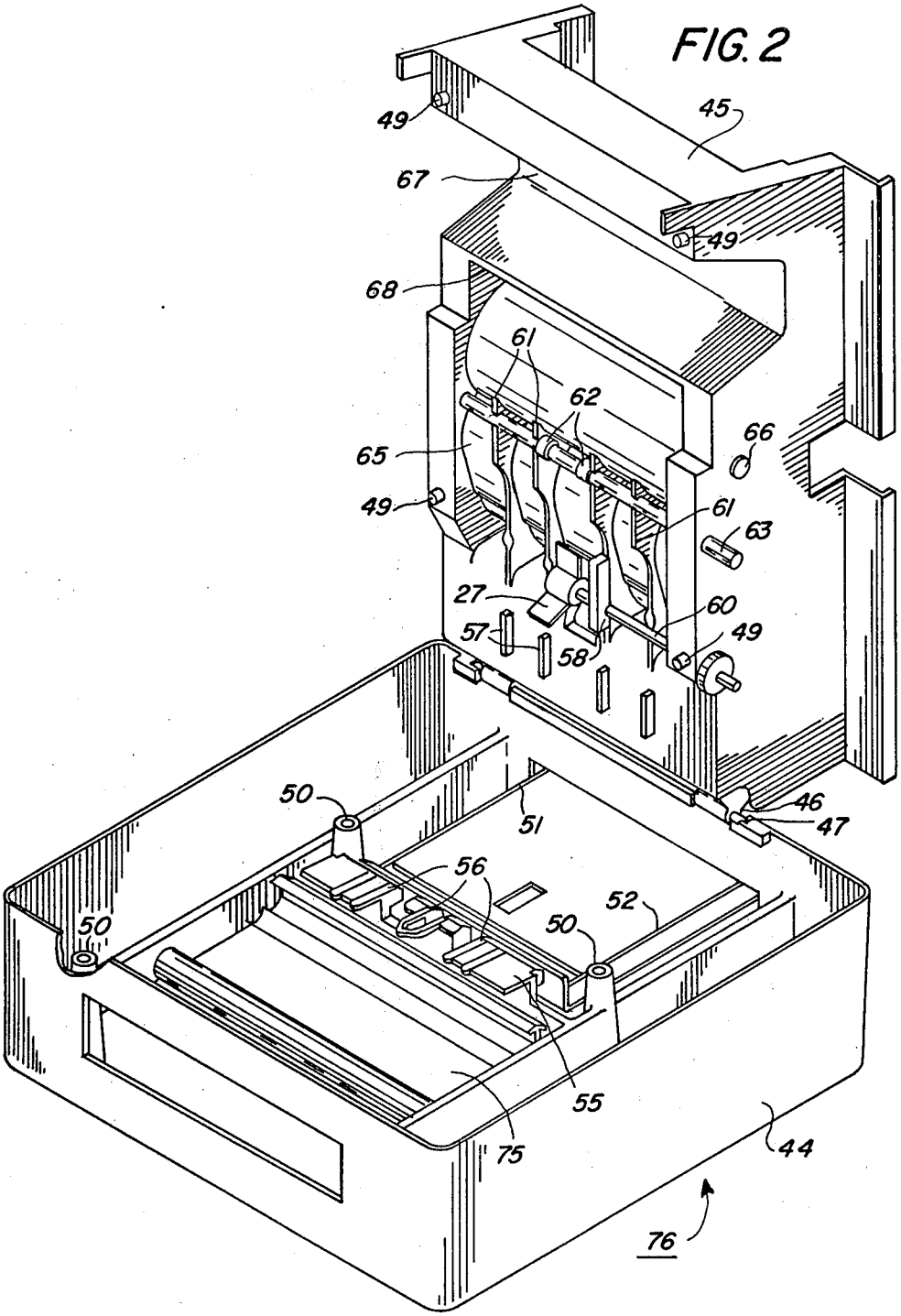
FIG. 2 is an isometric view of the upper and lower frame members opened to show the integrated nature of the top sheet guides and lower registration platen.

Referring more particularly to FIG. 2 where the integrated frame and sheet guiding elements are illustrated in greater detail, lower frame member 44 and upper frame member 45 are each one piece of molded plastic and are mounted or hinged in clamshell fashion about integrally molded hinge members 46 and 47 at the copy sheet cassette insertion end of the reproducing machine. Such hinging action provides ready access to the machine copy sheet path. The upper and lower frame members have the operational elements of the reproducing machine precisely located in the integrally molded plastic frame structure. The upper and lower frames when they are closed are accurately positioned relative to each other by upper datum pins 49 and lower datum pin supports 50. With such precision positioning between the four datum points, all the cooperating operational elements in both the upper and lower frame members are precisely mounted relative to each other. The top of the lower frame member and the bottom of the upper frame member provide a sheet transport path in the closed position. As is more readily depicted in FIG. 1, this path is a relatively straight path from the copy sheet supply tray 28 to the copy sheet output tray 36. With reference once again to FIG. 2, the lower frame member 44 has an opening 51 through which a copy sheet supply tray may be partially inserted into its body. Upon insertion the copy sheet supply tray is guided by lower tray guide members 52 into a fixed position against the lower registration platen 55 and held in position by small magnets (not shown) mounted on the side of the lower registration platen.

The lower registration platen 55 which is shown in greater detail in FIG. 3, is integrally molded into lower frame member 44 and provides a series of copy sheet guiding elements 56 in the form of raised ribs above the platen. In addition, molded directly into the sides of the registration platen are the snap mounts for mounting the separation registration gate assembly.

The cooperating paper handling structure in the upper frame member 45 includes a first set of guiding elements or ribs 57 which guide the top of the cassette into the machine frame. Secondly the mounts 58 are integrally molded in the upper frame for the paddle wheel feeder 27 and its drive shaft 60. It should be noted that neither the paddle wheel 27 or its drive shaft are integrally molded in the upper frame but rather are separate. Just beyond the paddle wheel in the sheet feeding direction are the second set of upper sheet guiding elements or ribs 61 which cooperate with lower copy sheet guiding elements 56 in insuring that the copy sheet is flat and can be accurately fed first to the registration gate and secondly to the transfer station. Preferably the upper sheet guiding elements 61 and the lower sheet guiding elements 56 are offset or staggered relative to each other rather than being exactly opposite each other. This enables a far greater dimensional latitude for sheet transport between the two sets of guiding elements. This unique cooperation between the integrally molded ribs of the lower and upper sections minimizes the possibility of copy sheet jams or damage to the copy sheets. More specifically, the upper sheet guides prevent the paper from entering the developer zone and in addition guide the sheet into the registration assembly and transfer zone. The lower guides prevent paper from entering the transfer and detack corotrons and also guide the sheet into the registration assembly and transfer zone. Positioned within the upper guiding elements are continuously driven feed rolls 62 driven by shaft 63 which is driven by means not shown and which cooperates with movable pinch rolls which will be described with reference to the separation registration gate assembly.

In addition to the integration of the copy sheet transport system other operational elements are also integrated into the molded frames. As may be more clearly seen with additional reference to FIG. 4, a majority of the machine elements are mounted to the upper frame member 45. Furthermore where possible, certain elements have been integrally molded directly into the upper frame. A major portion of the developer housing 65 is integrally molded into the upper frame as may be more clearly seen from FIG. 4. FIG. 2 also shows the underside of the developer housing 65 integrally molded within the upper sheet guiding elements. Thus with the developer housing integrally molded there is no separate developer subassembly. Further, since the developer roll, the cross-mixer and the trim bar may be mounted directly to the mounts, bosses, holes etc. which are molded directly into the upper frame the possibility of misalignment or readjustment is substantially lessened. Once the developer assembly is integrated, it is relatively easy to integrate the mounting on the upper frame for the drum and maintain the required fine dimensional tolerance levels. An additional advantage to increasing the integration is that with further elements bridging the sides of the frame the rigidity of the frame and thereby the machine is substantially increased. The dimensional tolerance required between operational elements are readily adhered to by molding the various elements or their mounting elements directly into a single frame.

Figure 4:
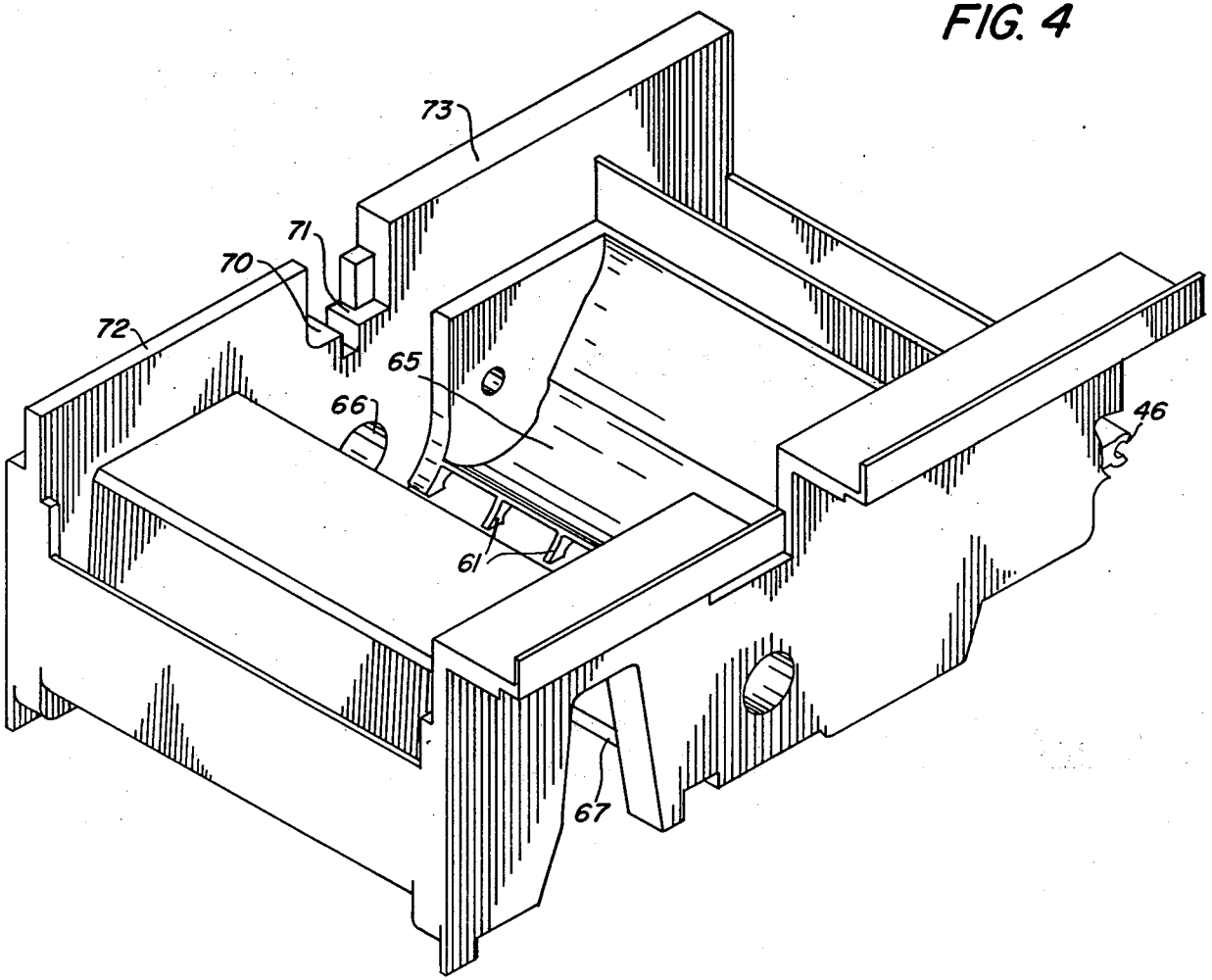
FIG. 4 is an isometric view of the upper frame member showing the integration of operational elements from the top.

In addition to the elements already described, the upper frame has integrally molded thereon as may be seen by reference to FIG. 2 and 4 the drum mounting holes 66, the fuser cavity 67 into which a separate radiant fuser may be mounted. The incoming side 68 of the fuser cavity forms the back of the cleaner housing and the auger in the cleaner is mounted directly to the sides. As may be more clearly seen with reference to FIG. 4, integral mounts are also pivoted for the charge corotron mounting 70 and the optical lens assembly 71 together with the top of the cleaner assembly 72. Even the drive system for the entire machine may be integrated into one side of the upper frame. The moving platen may also be mounted directly on rails 73 of the upper frame. In addition to the elements already mentioned, the lower frame member has mounted in it the fuser base 75 and the mount for the output tray.

Since the upper frame pivots down into the lower frame member the lower frame member may also contain integrally molded covers as may be clearly seen in FIG. 2. The top of the machine may be covered by an associated separate molded cover to enclose the machine.

The integrated molded frames may be made from any suitable moldable material. Typically thermosetting plastics with structural reinforcement such as glass fibers may be used. A particularly satisfactory group of materials are the thermosetting moldable polyester compounds filled with from about 20 to about 25% of small glass fibers.

The integrated molded frames may be manufactured with any suitable molding technique such as compression molding or transfer molding. Compression molding is satisfactory for frames and covers such as the lower frame described above which is not very highly integrated. However for highly integrated structures such as the upper frame described above, the transfer molding process is preferred since only with this process can the required close tolerances on dimensional stability of the structure be maintained. In the transfer molding process a closed mold made up of a cavity, a core and two side slots is completely closed and a thick molding compound is inserted into the mold at elevated temperatures and pressures through a transfer pot by a piston which drives the material into all the regions of the mold. Typically the molding is carried out at pressures of about 1,000 pounds per square inch at standard molding temperatures of about 300° F. The transfer molding technique in addition to having the advantage of providing greater dimensional stability than compression or injection molding also has the advantage of being able to readily use a thick molding compound that is fiber reinforced thereby providing a molded product of greater structural integrity.

When the upper and lower frames are so constructed the desired degree of cooperation between the upper and lower frame is achieved. With each frame member having sheet guiding elements integrally molded therein, a sheet of copy paper may be readily and accurately guided and processed along its path through the reproducing apparatus. This provides the advantage of simplicity of design and construction, reduced number of parts in assembly, reduced assembly time and manufacturing cost while at the same time providing dimensional stability for the operational elements integrally molded into the frames.

Figure 3A:
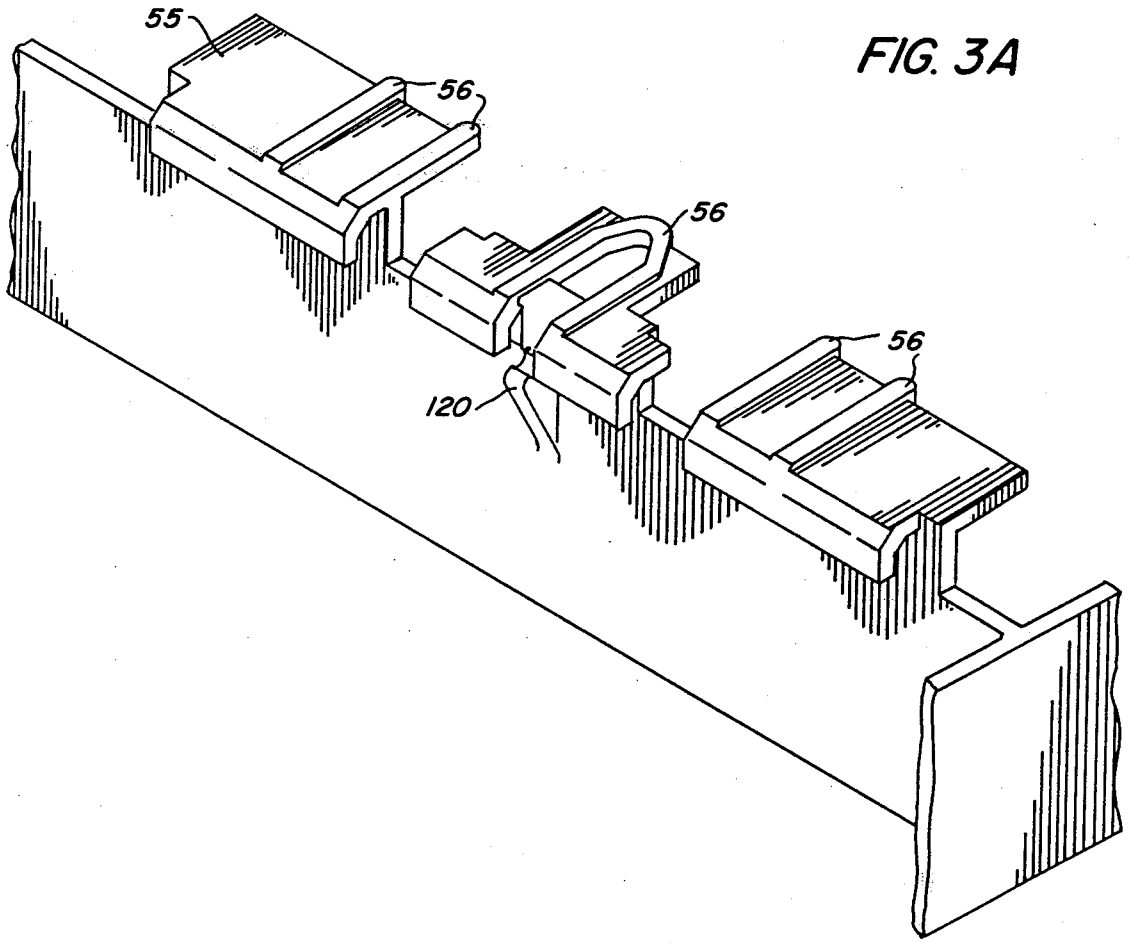
FIG. 3A is an enlarged isometric view of the lower registration platen with sheet bottom guiding elements.
Figure 3B:
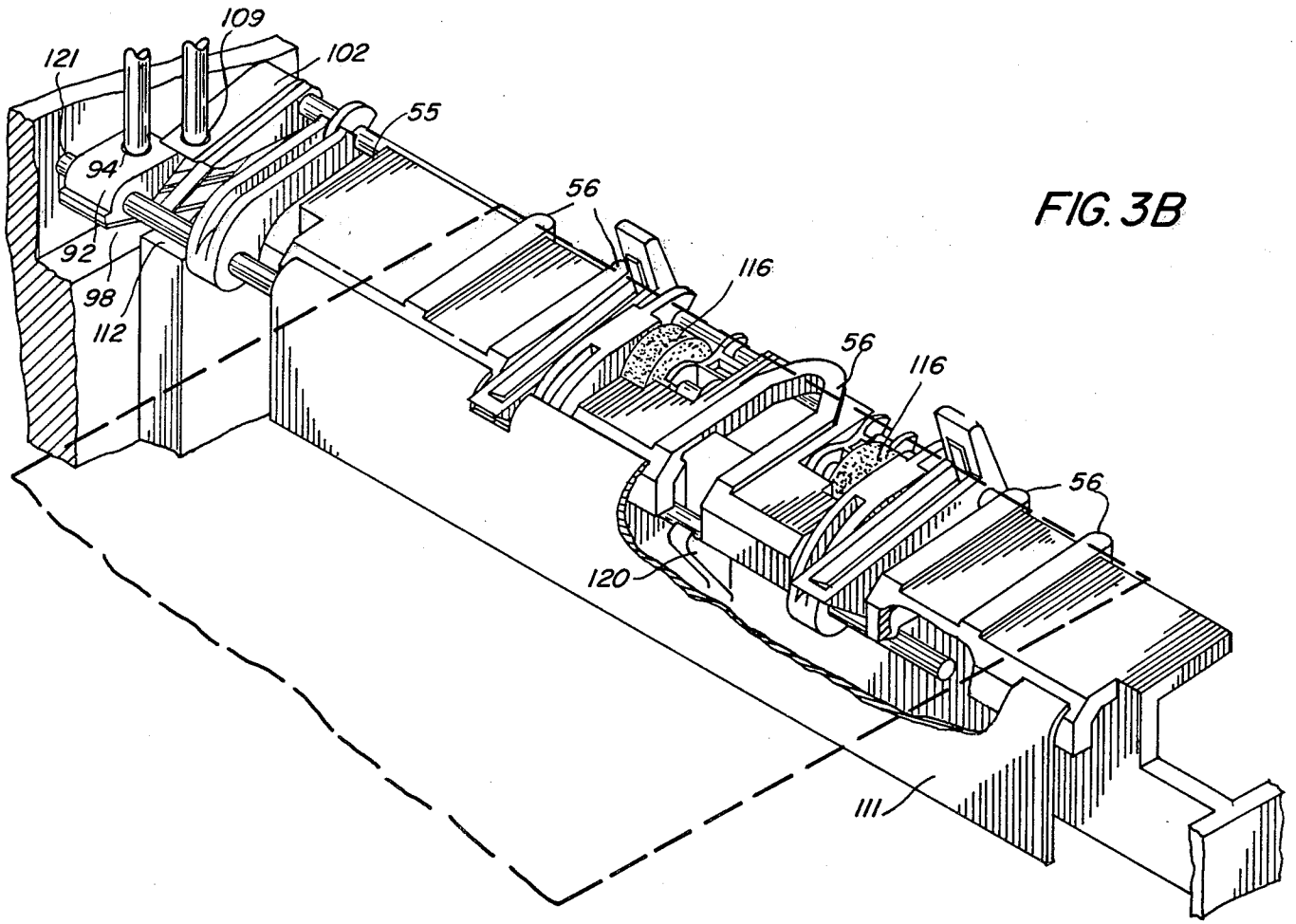
FIG. 3B is an isometric view from the rear of the lower registration platen with the separation registration gate assembly inserted therein and part of the sheet guide broken away.
Figure 3C:
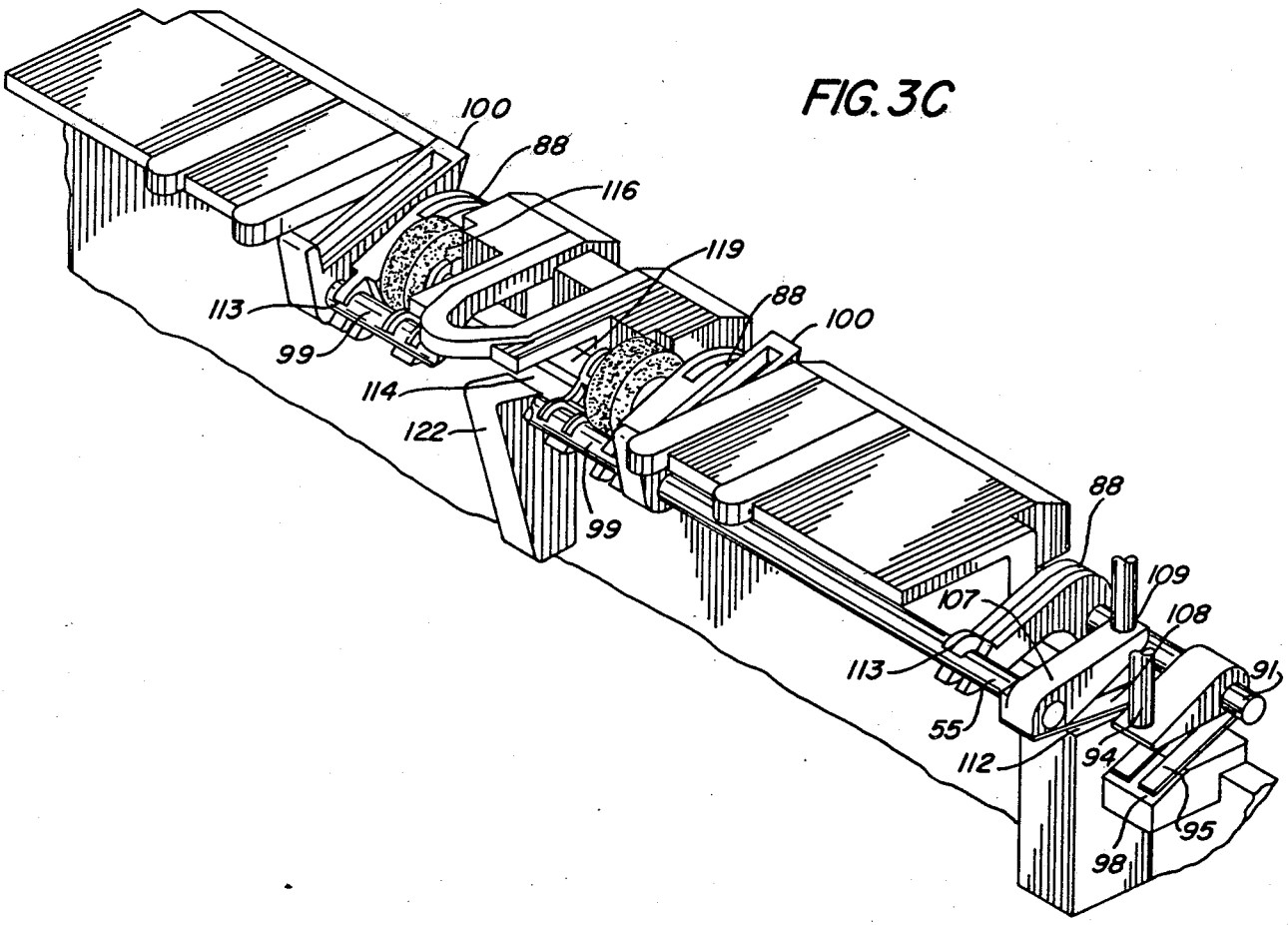
FIG. 3C is an isometric view from the front of the lower registration platen with the separation registration gate assembly inserted therein.

The copy sheet separation and registration apparatus is illustrated with continued reference to FIGS. 3A, 3B, 3C and additional reference to FIGS. 5, 6A–6D and FIG. 7. The separation and registration assembly includes three subassemblies, an arm assembly, a gate assembly and a rocker assembly as illustrated in the unassembled view of FIG. 7. The arm assembly comprises three support arms 88 outsert molded on arm shaft 91. The term outsert molded as used herein is intended to refer to those items produced when a metal shaft is actually placed in the mold and the fluid plastic is then injected into the mold. In this way a very tight fit can be assured between the plastic arms and the metal shaft. At the end of the arm shaft 91 is the arm spring 92 also outsert molded onto the shaft. The arm spring comprises an upper support member 93 having a dimple 94 in its top into which the activation push rod may be inserted as will be described later. Fastened to the bottom of the upper support members are spring leafs 95 which when the separation registration assembly is inserted into the integrated registration platen 55 of the lower frame 44 rests on frame mount 98.

The gate assembly includes a gate arm 99, two separation registration gates 100 and a gate spring 102 all outsert molded on the gate arm 99. Each of the separation registration gates includes a first separation edge 105 and a second registration gate 106. The gate spring 102 includes gate support member 107 having a dimple 109 in its top into which an actuation rod may be inserted and spring leaf 108 mounted at the bottom and which when the separation registration assembly is inserted into the integrated registration platen 55 of the lower frame 44, rests on frame 112. The gate arm 99 snaps into molded plastic snap mounts 113 at the end of the three support arms 88.

Figure 5:
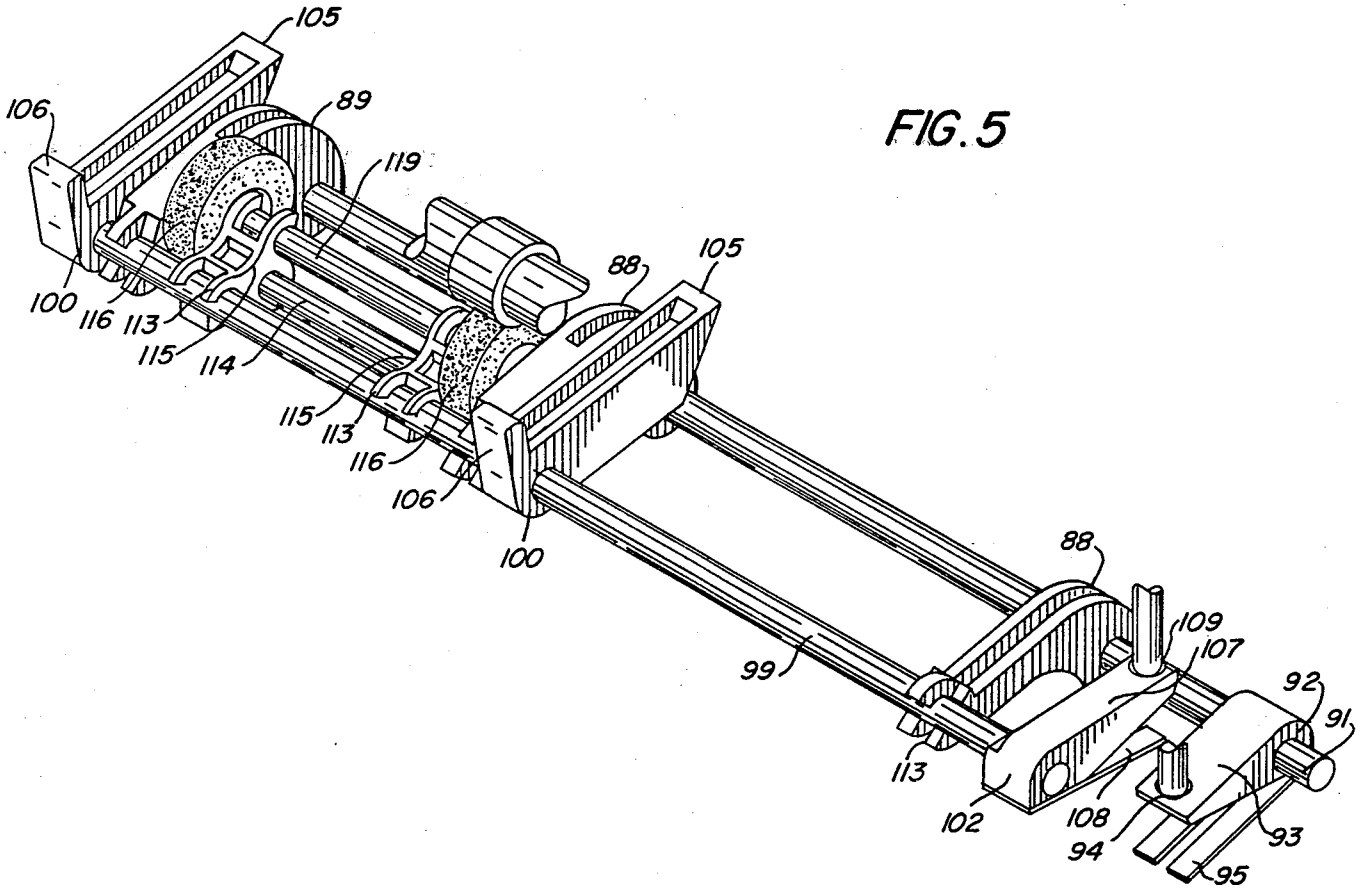
FIG. 5 is an isometric view of the separation registration assembly.

The rocker assembly 87 includes rocker shaft 114 to which are outsert molded two yoke support members 115. The yoke support members have two snap fittings at each end, one for the gate arm 99 and one for the pinch roll arm 119. The pinch roll arm with pinch rolls 116 is inserted into the snap fitting on the yoke 115 to provide the entire assembly as seen in FIG. 5. As may be seen with reference to FIG. 3B, when mounted in the registration platen assembly, the arm shaft 91 snap fits into three holders 120 molded into the frame just under the registration platen and into end support 121. The arm spring 92 and gate spring 102 are also positioned to rest on frame mounts 98 and 112 respectively. In addition, the rocker shaft 114 rests on rocker ramp 122 (See FIGS. 6A-6D).

Figure 6A:
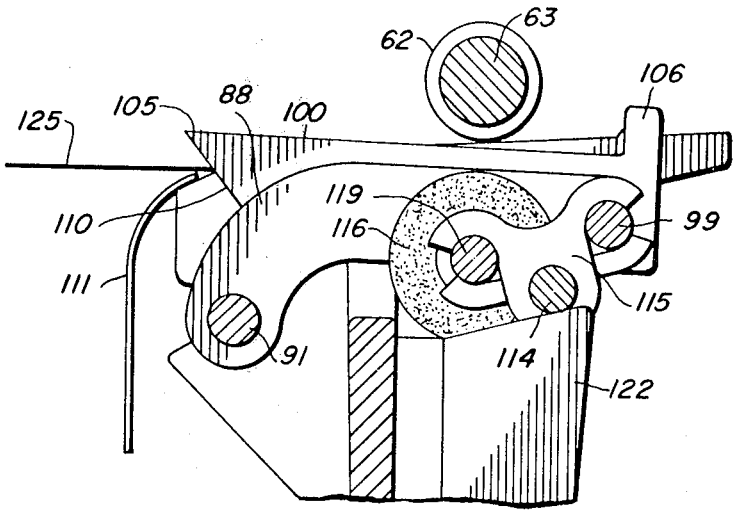
FIGS. 6A, 6B, 6C and 6D are side views of the sheet separation registration apparatus showing four positions of the separation edge and the registration gate.
Figure 6B:
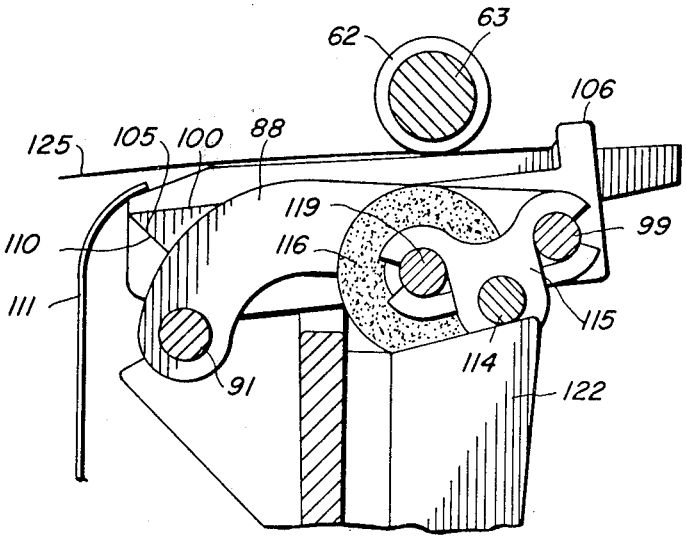
Figure 6C:
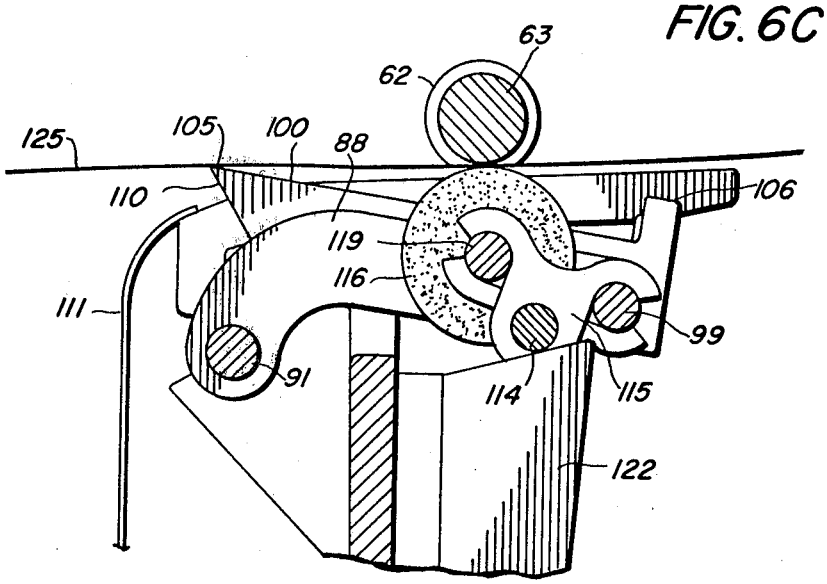
Figure 6D:
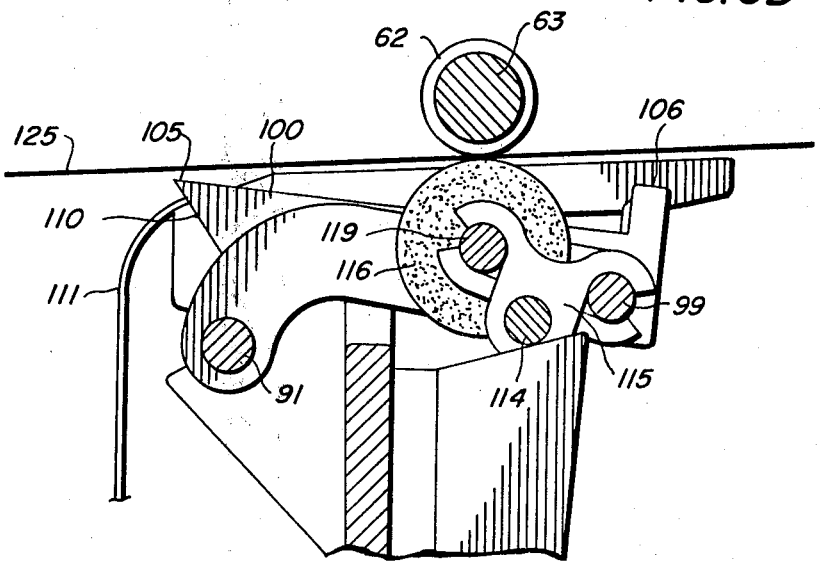
Figure 7:
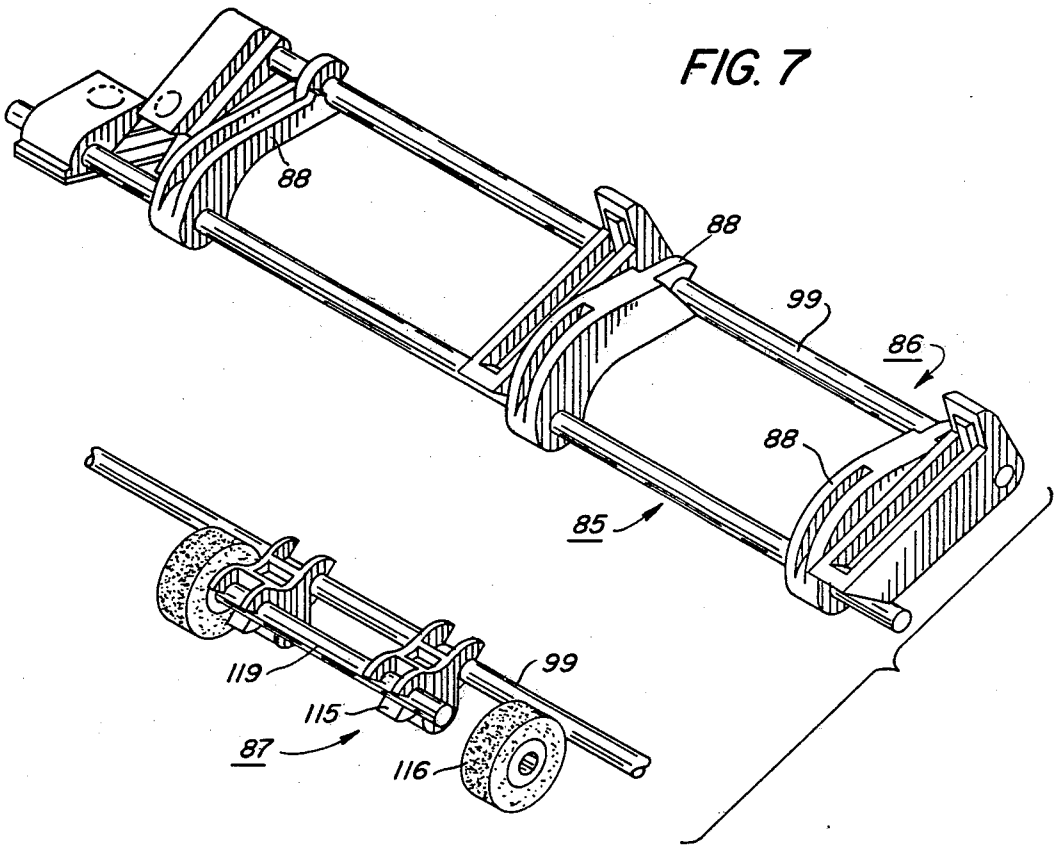
FIG. 7 is an isometric view of the separation registration assembly with the rocker assembly removed.

The separation registration action when in operation may be more clearly seen with reference to FIGS. 6A, 6B, 6C and 6D. The entire assembly is pivotally mounted on arm shaft 91 with the arm spring 92 and gate spring 102 resting on frame mounts 98 and 112 respectively with activation solely by the push rods in dimples 94 and 109 (See FIGS. 3B and 3C). FIG. 6*a* illustrates the standby condition with neither the arm or gate spring being depressed and with a sheet of paper 125 being held by the separator edge 105. At the start of scan or registration position in FIG. 6B, a push rod has depressed the spring on the end of the gate arm thereby lowering the separation gate 105 and bringing the full registration gate 106 to its upright position. In this position the lead edge of the sheet being fed may be registered against the registration gate. Immediately following registration as depicted in FIG. 6B, a push rod depresses arm spring 92 and the gate assembly pivots about arm shaft 91 withdrawing registration gate 106 below the level of the paper as may be seen in FIG. 6C. In addition, with the rocker shaft 114 held stationary by the rocker ramp 122 and the gate arm 99 rotated clockwise, the pinch roll arm rotates clockwise also driving pinch rolls 116 into contact with continuously driven feed rolls 62 thereby driving the registered sheet forward. In the attitude shown in FIG. 6C and with any continuously driven paper separation feeder such as the continuously rotating paddle wheel feeder herein illustrated, after the trailing edge of the sheet being fed clears the separation gate, the next sheet is driven into the separation gate. In some instances the high degree of rotation of the registration gate 106 clockwise drives the separation gate 105 up to a level that the sheet being fed contacts the guide elements on the bottom of the upper frame producing corrugations in the paper and perhaps permitting the second sheet to become wedged under the separation gate. To prohibit this from happening the position of the gates may be corrected slightly by having the push rod depressing the gate arm slightly so that the gate spring comes to a level to maintain the optimum level of the separation gate. This is called the kinematic correction factor and is illustrated in FIG. 6D.

Figure 8:
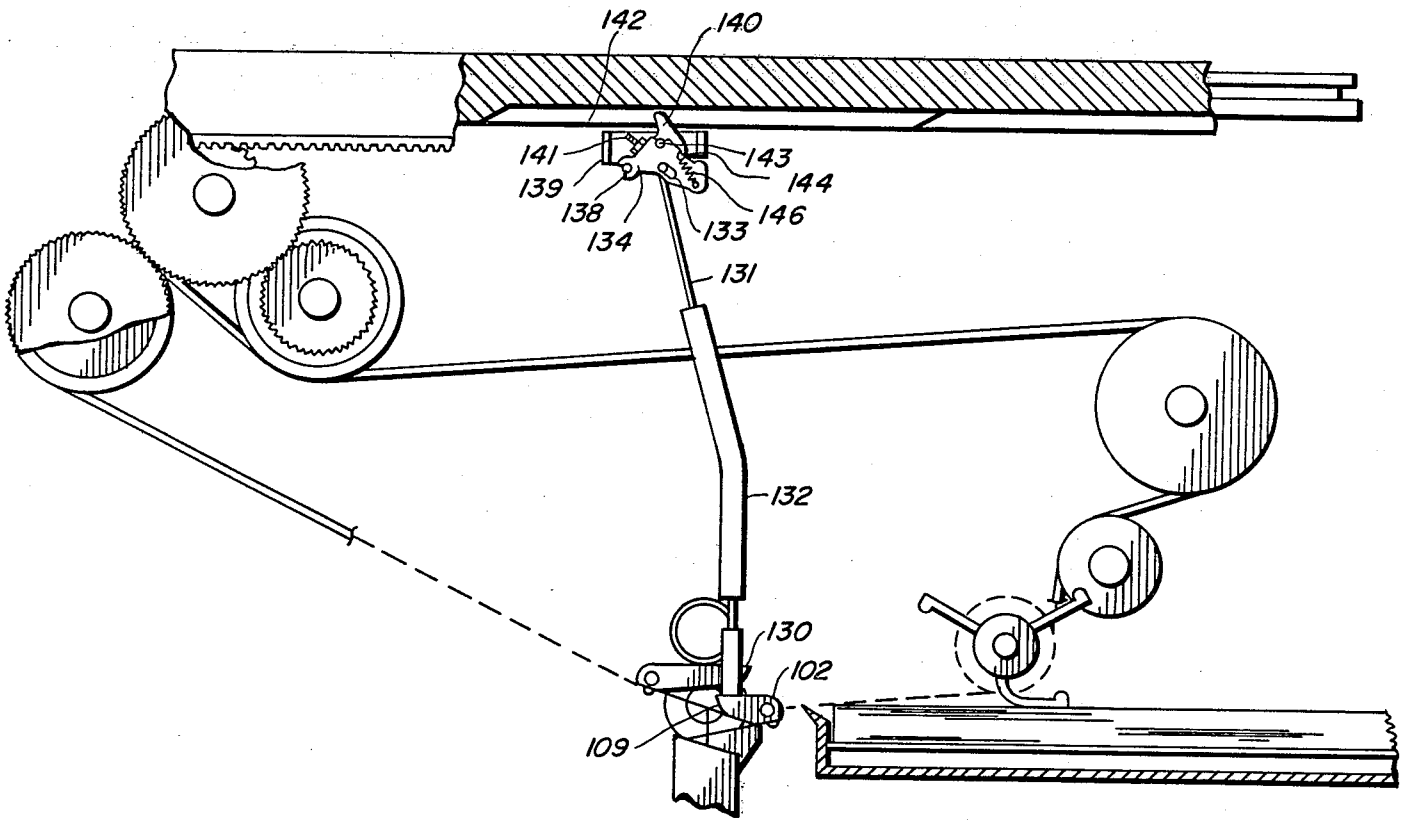
FIG. 8 is a representative side view of the document transport, sheet feed apparatus and separation registration gate actuation assembly.
Figure 9:
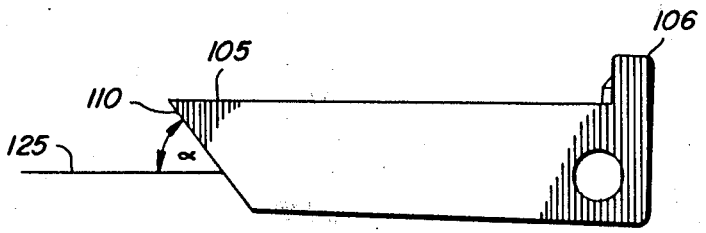
FIG. 9 is a side view of the linear reciprocating cams that actuate the push rod for actuating the sheet separation registration gate.

As mentioned briefly earlier, the separation gate assembly is activated by a push rod arrangement more fully described with references to FIGS. 8 and 9. There are two push rods, one for each of the arm spring 92 and the gate spring 102 which are controlled by a linear reciprocating cam mounted underneath the moving document platen on one side. Thus as the moving platen transports a document to be reproduced past a scanning slit, from left to right, the linear cam on the underside of the platen rail is used to activate the copy sheet separation and registration system so that a sheet may be fed in registration from right to left.

FIG. 8 shows one of the push rod assemblies, the second assembly being parallel to the one depicted and of the same construction. At the lower end a bullet 130 attached to one end of the push rod 131 rests in dimple 109 of gate spring 102 and the gate spring urges the push rod up so that the cam follower remains in contact with the cam track 142. A plastic sleeve 132 protects the push rod and supports it and guides the push rod while the sleeve is firmly mounted in a casting in the upper frame. The top end of the push rod 131 rests in a slot 133 in the cam follower assembly side plate 134 which is pivotally mounted about axis 138 in a housing 139 which is fixedly attached onto the upper frame. A cam follower 140 is pivotally attached to the side plate 134 at pivot point 143. With both the cam follower 140 and the push rod being attached to the side plate, the adjustment of the total length of actuation arm may be controlled by adjustment screw 141 which adjusts the location of the push rod 131 in the slot 133 and thereby the total length of the actuation arm. The cam follower 140 rides in cam track 142 and pushes the push rod down when it hits an elevated portion in the cam track thereby depressing the gate spring. The push rod mechanism is designed to function in one direction only while the linear reciprocating cam attached to the moving platen moves in a scan and rescan direction. In the embodiment depicted in FIG. 8 the cam follower is angled such that it operates when the cam is driven to the right. Thus during scanning of the platen to the right a raised portion of the cam track passing the stationary cam follower will drive the push rod down. On the rescan to the left the cam follower 140 which is pivotally mounted about pivot point 143 is knocked or flopped down by the raised portions of the cam track without activating the push rod. To insure that the cam follower is in the angled upright position on a subsequent scan, a spring 146 mounted on the side plate 134 at 147 pulls the end of the pivotally mounted cam follower 140 down so that it is in the upright position with the lower portion 144 of the cam follower resting against the stop portion 145 of the side plate.

The cam track is illustrated in greater detail in FIG. 9 which depicts two linear cams 150, 151 that may be attached to the bottom of the moving platen, one of which is the activating means for the registration gate and the other which is the activating means for the arm assembly. During scanning from right to left the cam follower 140 is depressed by the raised portions of the cam track. As can be seen by viewing both cam tracks, the time $t_3$ is the start of scan position to the release of paper by the separation gate, the time $t_4$ is the time of release of paper by the separation gate to the registration gate and the time $t_2$ is the time from lowering the registration gate through the entire scanning of the document. It should be noted that during the time $t_2$ the separation gate cam surface is not returned to the standby condition but rather is slightly elevated to provide the kinematic correction on the height adjustment of the separation gate as described above.

Figure 10:
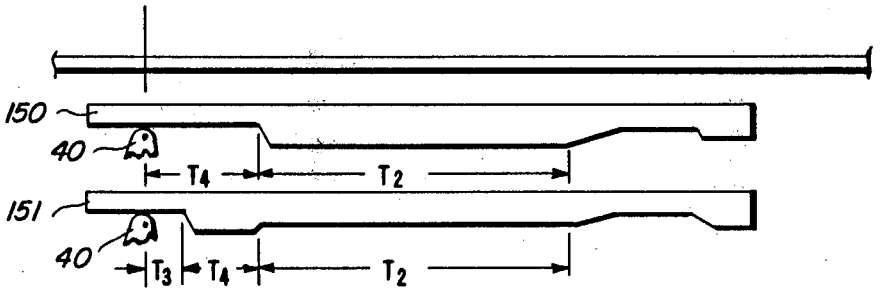
FIG. 10 is a side view of the single element separation registration gate illustrating the separation angle.

Referring once again to FIG. 6A wherein the side view of separator edge 105 with separation face 110 is depicted to be at an angle to the horizontal. While any suitable separation angle may be used the best balance between separating successive sheets and minimizing damage to the lead edge of sheets is with a separation angle of from about 45° to about 55°. The separation angle is the angle of the face of the separation gate relative to the plane of the incoming sheet as illustrated in FIG. 10. With angles more than about 55° there is a greater propensity for the sheet to jump over the face or edge of the separation gate and with angles less than about 45° the propensity for lead edge damage of the copy is increased. This is experienced since the separation gate is rotated down past the level of the lead edge of the sheet when it is retracted from the separator position and the sheet is held in place by paper guide 111 to permit the sheet to be fed forward to the registration gate and during this operation the face of the separation gate gently pushes the lead edge of the separated sheet back toward the paper supply a small distance in order to clear the path for the sheet. In so doing if the angle between the copy sheet and the face of the separation gate is too large, the separation gate will tend to damage the copy sheet by way of tearing or curling the lead edge when it is rotated down past the lead edge of the copy sheet to the non separation position. Optimum balance between the propensity for sheets jumping over the face of the separation gate and damaging the lead edge of sheets is achieved with a separation angle of about 50°. While the sheet and the plane of the separating registration gate are depicted as being horizontal it should be noted that they may be slightly pitched. For example, the path of the incoming sheet may be slightly inclined to the horizontal or the separation gate may be slightly pitched relative to the horizontal as depicted in FIG. 6A. In any of these configurations the important relationship is the angle of the separation gate face relative to the plane of the incoming sheet. This relationship exists for sheet feeding devices that are generally characterized as being high inertial feeding, low normal force devices such as the continuously running paddle wheel of this system. In these devices a continuously running paddle wheel positioned on top of a stack of sheets to be fed gently urges the top sheet to separate from the next successive sheet and proceed to the separation gate. The normal force on the separated sheet is relatively low and does not damage the copy sheet while constantly nudging it against the separation gate. The friction between the lead edge of the paper and the separation gate face holds the sheet from further forward travel. This is in sharp contrast to the high normal force feeding system where a feed roll is urged against a stack of sheets and separates and feeds the top sheet. Within the above range of angles between the separation gate face and the plane of copy sheet transport the higher the friction between the lead edge of the copy sheet being separated and the separation gate, the greater the permissible separation angle without the lead edge jumping over it.

In the sheet feeding process the paddle wheel gently urges the top sheet forward, the sheet reaches the separation gate and remains there until the gate is lowered while the paddle wheel continues to urge it forward. When the gate is lowered the sheet is urged forward by the paddle wheel to the registration gate. When the registration gate is lowered the pinch rolls pivot up and the sheet is driven forward. At the same time the trailing edge of the top sheet has cleared the paddle wheel and the paddle wheel now urges the second sheet forward toward the separation gate. The separation registration gate system described herein provides a simple and inexpensive device in which to stop the second sheet from interferring with the registration and subsequent feeding of the top sheet.

The patents referred to specifically in the detailed description of this application are intended to be incorporated by reference into the description.

In accordance with the invention an automatic reproducing apparatus with upper and lower frame members having sheet guiding elements integrally molded therein is provided. While this invention has been described with reference to the specific embodiment described, it will be apparent to those skilled in the art that many alternatives, modifications or variations may be made by those skilled in the art. For example, instead of the operational elements being molded into plastic frame members they could be molded into metal frame members. Accordingly, it is intended to embrace all such alternatives and modifications as may fall within the spirit and scope of the appended claims.

We claim:

1. An automatic reproducing apparatus comprising a frame assembly for mounting thereto individual reproducing apparatus components, said frame assembly including a lower frame member of molded plastic material and an upper frame member of molded plastic material, said lower frame member having sheet bottom guiding elements integrally molded therein and said upper frame member having sheet top guiding elements integrally molded therein said upper and lower frame members being positioned relative to each other to provide at least a portion of a copy sheet transport path whereby a sheet of copy paper being processed through the reproducing apparatus is guided along its path by said sheet top and bottom guiding elements.

2. The automatic reproducing apparatus of claim 1 wherein said lower frame member has integrally molded therewith bottom and lower side reproducing machine covering panels to thereby form a single integral machine lower frame and cover unit.

3. The automatic reproducing apparatus of claim 1 wherein said lower frame member and said upper frame member each have mounting means integrally molded therein to pivotally mount them relative to each other such that when they are in the closed position they provide a copy sheet transport path along a portion of which a copy sheet may be guided by said sheet top and bottom guiding elements.

4. The automatic reproducing apparatus of claim 3 further including means to securely position the upper and lower frame members relative to each other when they are in the closed position.

5. The automatic reproducing apparatus of claim 4 wherein said means to securely position said upper and lower frame members comprises at least two cooperating datum points in each of the lower and upper frame members.

6. The automatic reproducing apparatus of claim 2 wherein said upper frame member comprises the main frame upon which the majority of machine elements are mounted, said upper frame member having machine element mounting means integrally molded into both its sides for placement of machine elements on both the top portion and the bottom portion of said frame.

7. The automatic reproducing apparatus of claim 6 further including a top cover which together with the bottom frame member encloses the upper frame member.

8. The automatic reproducing apparatus of claim 1 wherein said upper frame member has integrally molded therein at least a portion of the developer housing and further has integrally molded mounting means for the developer roll.

9. The automatic reproducing apparatus of claim 8 wherein said upper frame member further includes integrally molded mounting means for the developer cross-mixer and the developer trim bar.

10. The automatic reproducing apparatus of claim 8 wherein said upper frame member further includes integrally molded mounting means for a photoconductor drum.

11. The automatic reproducing apparatus of claim 1 further including registration gate mounting means integrally molded in said lower frame member in operative association with said bottom sheet guiding elements.

12. The automatic reproducing apparatus of claim 11 further including paper tray insertion guide means and support means integrally molded in said lower frame member.

13. The automatic reproducing apparatus of claim 12 wherein said integrally molded guiding elements in said upper frame member comprise two sets of guiding ribs molded into said frame, one set positioned opposite the paper tray support means of said lower frame and one set positioned opposite said registration gate mounting means and said sheet guiding elements in the lower frame member.

14. The automatic reproducing apparatus of claim 13 further including paper feeder mounting means integrally molded in said upper frame member and positioned between said two sets of guiding ribs.

15. The automatic reproducing apparatus of claim 1 wherein said sheet guiding elements in said upper frame member are staggered from said sheet guiding elements in said lower frame member.

* * * * *